US012607411B2

(12) United States Patent
Kishida et al.

(10) Patent No.: US 12,607,411 B2
(45) Date of Patent: Apr. 21, 2026

(54) HEAT EXCHANGER AND AIR-CONDITIONING APPARATUS INCLUDING HEAT EXCHANGER

(71) Applicant: Mitsubishi Electric Corporation, Tokyo (JP)

(72) Inventors: Nanami Kishida, Tokyo (JP); Yoji Onaka, Tokyo (JP); Takashi Matsumoto, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 314 days.

(21) Appl. No.: 18/025,939

(22) PCT Filed: Sep. 23, 2020

(86) PCT No.: PCT/JP2020/035720

§ 371 (c)(1),
(2) Date: Mar. 13, 2023

(87) PCT Pub. No.: WO2022/064554

PCT Pub. Date: Mar. 31, 2022

(65) Prior Publication Data

US 2023/0358479 A1 Nov. 9, 2023

(51) Int. Cl.

| | |
|---|---|
| ***F28D 7/16*** | (2006.01) |
| ***F28F 1/12*** | (2006.01) |
| ***F28F 9/02*** | (2006.01) |

(52) U.S. Cl.

CPC ..... *F28D 7/16* (2013.01); *F28F 1/12* (2013.01); *F28F 9/02* (2013.01)

(58) Field of Classification Search

CPC ..... F28D 7/16; F28F 1/12; F28F 9/02

See application file for complete search history.

(56) References Cited

U.S. PATENT DOCUMENTS 8,910,704 B2 * 12/2014 Mizuno ..... F28F 9/0209 165/173
9,976,820 B2 5/2018 Okazaki et al.
(Continued)

FOREIGN PATENT DOCUMENTS

CN 101120226 A 2/2008
CN 101482349 A 7/2009
(Continued)

OTHER PUBLICATIONS

European Search Report mailed Sep. 29, 2023, in European Application No. 20955148.0, 7 pages.
(Continued)

*Primary Examiner* — Jianying C Atkisson
(74) *Attorney, Agent, or Firm* — XSENSUS LLP

(57) ABSTRACT

A heat exchanger includes a plurality of heat transfer pipes provided at spacings from each other in a first direction, a header having an insertion hole in which a front end of each of the plurality of heat transfer pipes is inserted from a second direction orthogonal to the first direction, and a fin attached to heat transfer pipes. The header includes a divider configured to divided the inside of the header into a first space in which the insertion hole is provided and a second space to which a refrigerant pipe is connected. The divider is provided with an opening surrounding the outer periphery of the front end of the heat transfer pipe as seen from the second direction. An air-conditioning apparatus includes the heat exchanger as a condenser or an evaporator.

13 Claims, 7 Drawing Sheets

(56) References Cited

U.S. PATENT DOCUMENTS

| | | | | |
|---|---|---|---|---|
| 10,436,526 | B2 * | 10/2019 | Bronner | F28F 1/02 |
| 12,092,407 | B2 * | 9/2024 | Choi | F28F 9/0209 |
| 2005/0178525 | A1 * | 8/2005 | Pierce | F28F 9/162 165/79 |
| 2005/0217838 | A1 | 10/2005 | Katoh et al. | |
| 2008/0289806 | A1 | 11/2008 | Gorbounov et al. | |
| 2009/0178435 | A1 * | 7/2009 | Hiyama | F25B 39/04 62/509 |
| 2012/0204595 | A1 | 8/2012 | Tamaki et al. | |
| 2012/0247742 | A1 * | 10/2012 | Mizuno | F28D 1/05391 165/173 |
| 2016/0061496 | A1 * | 3/2016 | Yanping | F28F 9/0273 165/174 |
| 2018/0023903 | A1 | 1/2018 | Mutou et al. | |
| 2023/0168047 | A1 * | 6/2023 | Miyawaki | F28F 1/022 165/174 |
| 2023/0288145 | A1 * | 9/2023 | Maema | F28F 9/0275 |
| 2023/0358479 | A1 * | 11/2023 | Kishida | F28F 9/0278 |

FOREIGN PATENT DOCUMENTS

| | | | | |
|---|---|---|---|---|
| EP | 2998681 | B1 | 3/2016 | |
| EP | 3150953 | A1 | 4/2017 | |
| JP | 3-030068 | U | 3/1991 | |
| JP | 2007183076 | A * | 7/2007 | F25B 39/00 |
| JP | 2009-166529 | A | 7/2009 | |
| JP | 2009-250518 | A | 10/2009 | |
| JP | 2011-085343 | A | 4/2011 | |
| JP | 4922712 | B2 * | 4/2012 | |
| JP | 2016-057036 | A | 4/2016 | |
| JP | 2016-125748 | A | 7/2016 | |
| JP | 2017-187256 | A | 10/2017 | |
| WO | 2017/208558 | A1 | 12/2017 | |

OTHER PUBLICATIONS

International Search Report and Written Opinion mailed on Nov. 2, 2020, received for PCT Application PCT/JP2020/035720, filed on Sep. 23, 2020, 12 pages including English Translation.

Notice of Reasons for Refusal mailed on Apr. 6, 2021, received for JP Application 2021-506590, 10 pages including English Translation.

Chinese Office Action issued Aug. 23, 2024, in corresponding Chinese Patent Application 202080103603.8, 13pp.

* cited by examiner

HEAT EXCHANGER AND AIR-CONDITIONING APPARATUS INCLUDING HEAT EXCHANGER

CROSS-REFERENCE TO RELATED APPLICATION

The present application is based on PCT filing PCT/JP2020/035720, filed Sep. 23, 2020, the entire contents of which are incorporated herein by reference.

TECHNICAL FIELD

The present disclosure relates to a heat exchanger including a header configured to collect or distribute refrigerant and an air-conditioning apparatus including the heat exchanger.

BACKGROUND ART

As a heat exchanger including a header to which a plurality of heat transfer pipes are connected, there has been known a heat exchanger configured such that the inside of the header is divided by a divider into a first space in which the plurality of heat transfer pipes are inserted and a second space in which the plurality of heat transfer pipes are not inserted. The divider has formed therein a communicating hole through which the first space and the second space communicate with each other (see, for example, Patent Literature 1).

Further, in Patent Literature 1, a problem caused by the resistance of passage through the communicating hole of the divider is addressed by tilting the communicating hole against a refrigerant flow direction and forming a guide configured to guide a flow of refrigerant toward a downstream edge in the refrigerant flow direction.

CITATION LIST

Patent Literature

Patent Literature 1: Japanese Unexamined Patent Application Publication No. 2016-57036

SUMMARY OF INVENTION

Technical Problem

In a related-art heat exchanger, it has been necessary for heat transfer pipes to protrude into a header so that the heat transfer pipes are connected and brazed to the header. The protrusion of the heat transfer pipes into the header causes ridges and grooves to be formed by protruding portions. This may cause an increase in pressure loss of refrigerant flowing through the header. Further, in Patent Literature 1, the refrigerant may suffer a pressure loss by colliding with the divider in flowing from the heat transfer pipes into the header.

The present disclosure was made to solve such a problem, and has as an object to provide a heat exchanger configured to reduce a pressure loss of refrigerant inside a header and be superior in heat exchange performance even with heat transfer pipes inserted in the header and an air-conditioning apparatus including the heat exchanger.

Solution to Problem

A heat exchanger according to an embodiment of the present disclosure includes a plurality of heat transfer pipes provided at spacings from each other in a first direction, a header having an insertion hole in which a front end of each of the plurality of heat transfer pipes is inserted from a second direction orthogonal to the first direction, and a fin attached to heat transfer pipes. The header includes a divider configured to divide an inside of the header into a first space in which the insertion hole is provided and a second space to which a refrigerant pipe is connected. The divider is provided with an opening surrounding an outer periphery of the front end of the heat transfer pipe as seen from the second direction.

Further, an air-conditioning apparatus according to an embodiment of the present disclosure includes a refrigerant circuit in which a compressor, a condenser, an expansion valve, an evaporator, and a four-way valve are connected by pipes and through which the refrigerant flows, and includes the aforementioned heat exchanger as the condenser or the evaporator.

Advantageous Effects of Invention

Embodiments of the present disclosure make it possible to provide a heat exchanger configured to, by including a divider configured to divide the inside of a header into a first space in which an insertion hole is provided and a second space to which a refrigerant pipe is connected and provided with an opening surrounding the outer periphery of the front end of a heat transfer pipe as seen from a second direction, be able to reduce a pressure loss of refrigerant and be superior in heat exchange performance and an air-conditioning apparatus including the heat exchanger.

DESCRIPTION OF EMBODIMENTS

Figure 1:
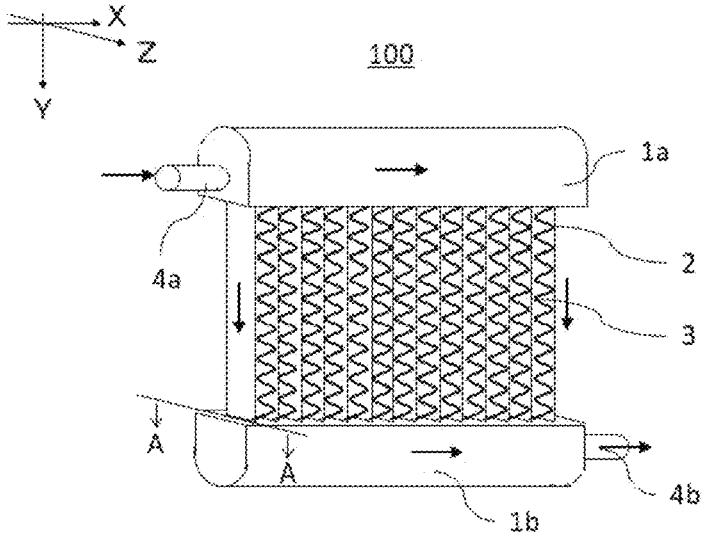
FIG. 1 is a schematic configuration diagram of a heat exchanger according to Embodiment 1.

First, embodiments of the present disclosure are described with reference to the drawings. Further, components given identical signs in the drawings are identical or equivalent to each other, and these signs are adhered to throughout the entire text of the description. It should be noted that the forms of components described in the entire text of the description are merely examples and are not limited to these descriptions.

Further, in the entire text of the description, directions orthogonal to one another are named as a first direction, a second direction, and a third direction. Moreover, although a case is described in which the first direction is a horizontal direction, the second direction a vertical direction, and the third direction a direction parallel with a headers width, for example, these directions are not limited to the orientation of flow of refrigerant or other directions. In the drawings, the X direction corresponds to the first direction, the Y direction to the second direction, and the Z direction to the third direction.

Further, directive terms such as "top", "bottom", "right", and "left" used as appropriate for ease of comprehension are intended for explanation's sake, and are not intended to limit the present disclosure. It should be noted that terms such as "top", "bottom," "right", and "left" are used in a view of a heat exchanger 100 from the side.

Embodiment 1

FIG. 1 is a schematic configuration diagram of a heat exchanger 100 according to Embodiment 1 of the present disclosure.

As shown in FIG. 1, the heat exchanger 100 according to Embodiment 1 includes a header 1 (1*a*, 1*b*), a plurality of heat transfer pipes 2, a fin 3, and a refrigerant pipe 4 (4*a*, 4*b*).

The header 1 (1*a*, 1*b*) has a tubular shape, includes a header top plate 11, a header body 12, a side lid 13, and a divider 14 (not illustrated), and is placed such that the header 1 (1*a*, 1*b*) has its length extending in a horizontal direction. In FIG. 1, the header 1 (1*a*, 1*b*) is placed such that the length of the header 1 (1*a*, 1*b*) extends in a direction orthogonal to the flow of air flowing in a direction from front to back of the sheet. Further, a cross-section of the header 1 (1*a*, 1*b*) taken along a vertical direction may have a rectangular shape or a circular shape, although FIG. 1 shows an example in which the cross-section has a D shape.

Further, the refrigerant pipe 4 (4*a*, 4*b*) and the plurality of heat transfer pipes 2 are connected to the header 1 (1*a*, 1*b*), and refrigerant flows inside. The header 1 includes a so-called distributing header la to which a refrigerant inflow pipe 4*a* is connected. The distributing header 1*a* distributes, to each of the plurality of heat transfer pipes 2, refrigerant flowing in from the refrigerant inflow pipe 4*a*. Further, the header 1 includes a so-called collecting header 1*b* to which a refrigerant outflow pipe 4*b* is connected. The collecting header 1*b* causes refrigerant flowing out from the plurality of heat transfer pipes 2 to be collected so that the refrigerant can be discharged out of the heat exchanger 100 via the refrigerant outflow pipe 4*b*. It should be noted that a configuration of the header 1 (1*a*, 1*b*) will be described in detail later.

The plurality of heat transfer pipes 2 are placed at spacings from each other in a first direction (X direction). The heat transfer pipes 2 each have a first end connected to the distributing header 1*a* and a second end connected to the collecting header 1*b*. The heat transfer pipes 2 are hollow metal pipes, usable examples of which include flap pipes that are flat in cross-section. Since the heat transfer pipes 2 are made from metal, the heat transfer pipes 2 have such high thermal conductivity that it is easy to exchange heat between refrigerant flowing through the heat transfer pipes 2 and air outside the heat transfer pipes 2. The exchange of heat between the refrigerant flowing through the heat transfer pipes 2 and the air outside the heat transfer pipes 2 makes it possible to cool and gasify the refrigerant or to heat and liquefy the refrigerant.

Although FIG. 1 shows an example in which the heat transfer pipes 2 are flat pipes, this is not intended to limit the shapes of the heat transfer pipes 2. Further, the air may be replaced by another fluid.

The fin 3 is, for example, a corrugated metal plate inserted between a plurality of heat transfer pipes 2 and, by being joined to surfaces of adjacent heat transfer pipes 2, attached to the heat transfer pipes 2. Since the fin 3 is formed by a material, such as metal, that conducts heat, the fin 3 can conduct heat from the heat transfer pipes 2 to which it was joined and exchange heat with air or other fluids flowing through a gap. Further, the corrugated shape makes efficient heat exchange possible with a large surface area in contact with a fluid, such as air, to exchange heat with.

The refrigerant pipe 4 (4*a*, 4*b*) is connected to a side lid 13 serving as a side of the header 1 (1*a*, 1*b*). As mentioned above, the refrigerant pipe 4 includes the refrigerant inflow pipe 4*a*, which is connected to the distributing header 1*a*, and the refrigerant outflow pipe 4*b*, which is connected to the collecting header 1*b*.

The refrigerant inflow pipe 4*a* causes refrigerant to flow from outside the heat exchanger 100 into the distributing header 1*a*, and the refrigerant outflow pipe 4*b* causes refrigerant collected in the collecting header 1*b* to flow out of the heat exchanger 100. As shown in FIG. 1, the refrigerant inflow pipe 4*a* and the refrigerant outflow pipe 4*b* are connected, for example, to sides differing from each other.

As indicated by solid arrows in FIG. 1, refrigerant flowing through the heat exchanger 100 flows from the refrigerant inflow pipe 4*a* into the distributing header 1*a* and is distributed by the distributing header 1*a* to each of the plurality of heat transfer pipes 2. The refrigerant thus distributed flows through the heat transfer pipe 2, is collected by the collecting header 1*b*, and is discharged through the refrigerant outflow pipe 4*b*.

The heat exchanger 100 is called an evaporator in a case in which refrigerant flowing into the heat exchanger 100 is in a two-phase gas-liquid state in which there is a mixture of gas refrigerant and liquid refrigerant and the two-phase gas-liquid refrigerant is evaporated by passing through the heat transfer pipes 2. Further, the heat exchanger 100 is called a condenser in a case in which refrigerant flowing into the heat exchanger 100 is gas and the refrigerant is condensed by passing through the heat transfer pipes 2. In a case in which the heat exchanger 100 is used as a condenser, the refrigerant flows in directions opposite to those indicated by the solid arrows in FIG. 1.

Next, a configuration of the header 1 of the heat exchanger 100 according to the present embodiment is described in detail. Although the following description takes the collecting header 1*b* as an example, the present disclosure is not limited to the collecting header 1*b* but may be directed to the distributing header 1*a*.

Figure 2:
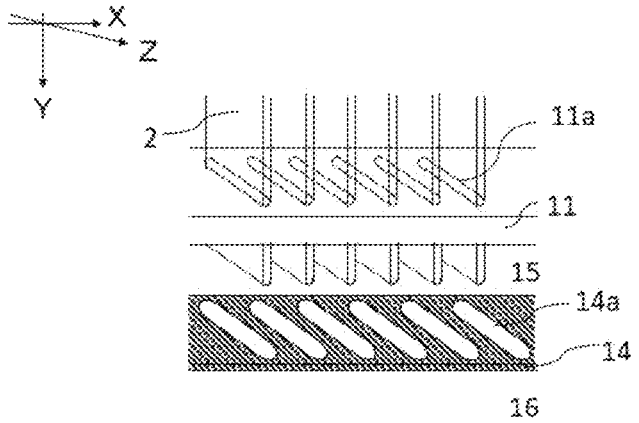
FIG. 2 is a perspective view partially showing a configuration of a collecting header according to Embodiment 1.
Figure 3:
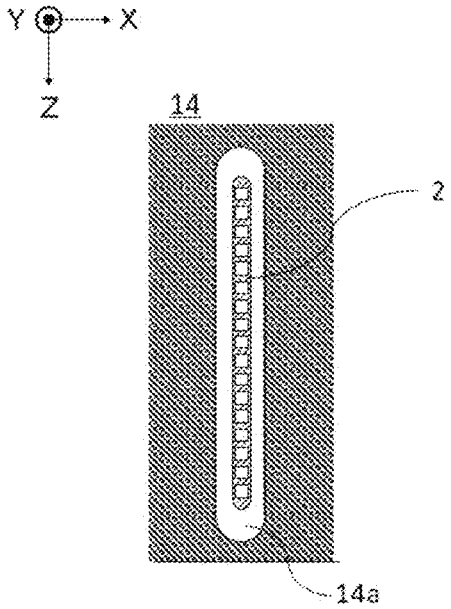
FIG. 3 is a cross-sectional view of the collecting header according to Embodiment 1 as seen from a second direction.
Figure 4:
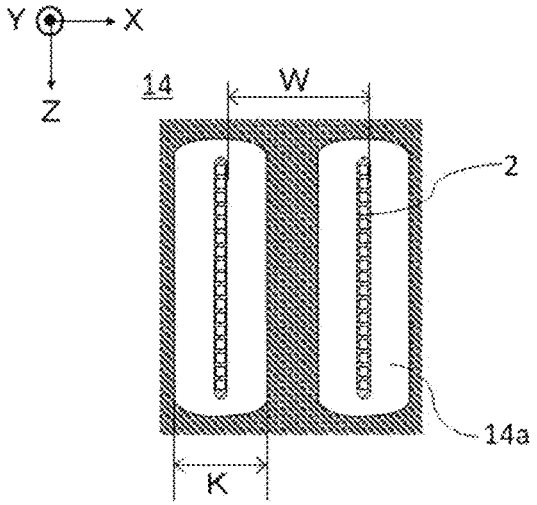
FIG. 4 is a diagram showing the width of an opening of a divider according to Embodiment 1.
Figure 5:
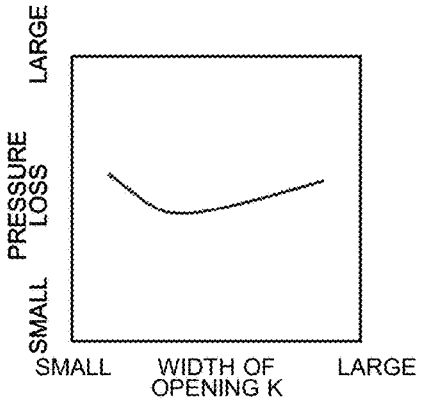
FIG. 5 is a diagram showing a relationship between the width of an opening of the divider according to Embodiment 1 and a pressure loss.

FIG. 2 is a perspective view partially showing a configuration of a header according to Embodiment 1. FIG. 3 is a cross-sectional view of the header according to Embodiment 1 as seen from a second direction, and shows a positional relationship between a heat transfer pipe 2 and an opening 14*a* of the divider 14. FIG. 4 is a diagram showing the width of an opening of the divider according to Embodiment 1. FIG. 5 is a diagram showing a relationship between the width of an opening 14*a* of the divider 14 according to Embodiment 1 and a pressure loss.

As shown in FIG. 2, the header top plate 11 of the collecting header 1*b* has provided therein insertion holes 11*a*, provided at spacings from each other in the first direction (X direction), in which the front ends of the plurality of heat transfer pipes 2 are inserted from the second direction (Y direction). Each of the heat transfer pipes 2 is inserted in a corresponding one of the insertion holes 11 a from the header top plate 11 toward the header body 12 and fixed gaplessly and airtightly by brazing or other processes between the header top plate 11 and the insertion hole 11*a*. That is, each of the heat transfer pipes 2 has its length extending in a vertical direction (second direction).

The divider 14 is a flat plate made from metal such as aluminum, and is fixed by brazing or other processes to the header body 12 and side lid 13 of the collecting header 1*b*. It should be noted that the divider 14 does not necessarily need to have its whole circumference fixed to an inner wall of the header body 12, and may allow refrigerant flowing through the collecting header to pass between the divider 14 and the inner wall of the header body 12. Further, the divider 14 may be formed integrally with the collecting header 1*b*. Further, as shown in FIG. 2, the divider 14 is provided with a plurality of the openings 14*a* into each of which the plurality of heat transfer pipes 2 can be inserted separately.

FIG. 3 is a view of the inside of the collecting header 1*b* from the bottom in the second direction (Y direction), and is a schematic view showing a positional relationship between a heat transfer pipe 2 and an opening 14*a* of the divider 14. The divider 14 is provided with an opening 14*a* surrounding the outer periphery of the front end of a heat transfer pipe 2, that is, an opening 14*a* that, when seen from the second direction, has a hole or space into which a heat transfer pipe 2 can be inserted.

Further, as shown in FIG. 3, the opening 14*a* provided in the divider 14 is shaped to have a gap between the opening 14*a* and the outer periphery of the front end of the heat transfer pipe 2 as seen from the second direction (Y direction). That is, when the inside of the collecting header 1*b* is seen from the second direction (Y direction), the opening 14*a* has a shape surrounding the heat transfer pipe 2 at a distance from the outer periphery of the front end of the heat transfer pipe 2. The shape of the opening 14*a* is not limited to the same shape as the heat transfer pipe 2, provided the shape has a gap between the opening 14*a* and the outer periphery of the front end of the heat transfer pipe 2 as seen from the second direction (Y direction).

As with FIG. 3, FIG. 4 is a view of the inside of the collecting header 1*b* from the bottom in the second direction (Y direction). Note here that as shown in FIG. 4, K denotes the width of an opening 14*a* in the first direction (X direction) and W denotes the distance between adjacent ones of the plurality of heat transfer pipes 2.

FIG. 5 is a diagram showing a relationship between the width K of an opening 14*a* and a pressure loss. The vertical axis represents a pressure loss inside the collecting header, and the horizontal axis represents the width K of an opening 14*a* in the first direction (X direction). As can be seen from FIG. 5, a pressure loss changes according to the width K of an opening 14*a*. At a certain width K, the pressure loss reaches its minimum, and as the width K becomes smaller or larger than the width, the pressure loss increases. An opening 14*a* provided in the divider 14 has a larger opening area than the cross-sectional area of the front end of a heat transfer pipe 2, but as shown in FIG. 5, if the width K of the opening 14*a* is too large, the pressure loss tends to increase. To address this problem, Embodiment 1 is configured such that an opening 14*a* provided in the divider 14 satisfies the relationship $K<W$. That is, the width K of an opening 14*a* in the first direction (X direction) is smaller than the distance W between adjacent ones of the plurality of heat transfer pipes 2.

It should be noted that the width K at which the pressure loss reaches its minimum was approximately twice as large as the width of a heat transfer pipe 2. That is, in a case in which the shapes of a heat transfer pipe 2 and an opening are flat shapes as shown in FIG. 4, the pressure loss can be minimized by making the width K of the opening 14*a* approximately twice as large as the width of the heat transfer pipe 2. Therefore, it is most preferable that the width K in the first direction (X direction) of an opening 14*a* provided in the divider 14 be twice as large as the width of a heat transfer pipe 2.

Next, the installation position of the divider 14 inside the collecting header is described.

Figure 6:
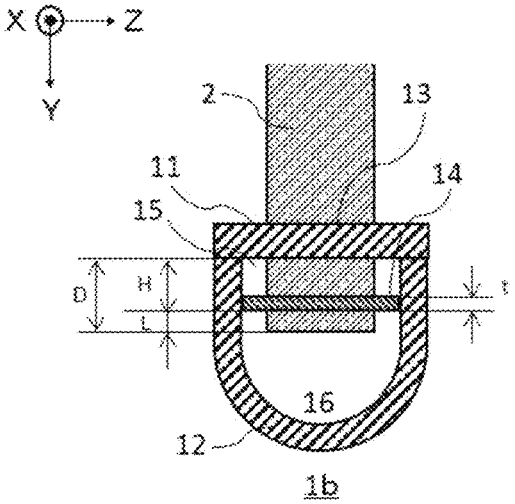
FIG. 6 is a cross-sectional view of the heat exchanger according to Embodiment 1 as seen from cutting-plane line A-A of FIG. 1.
Figure 7:
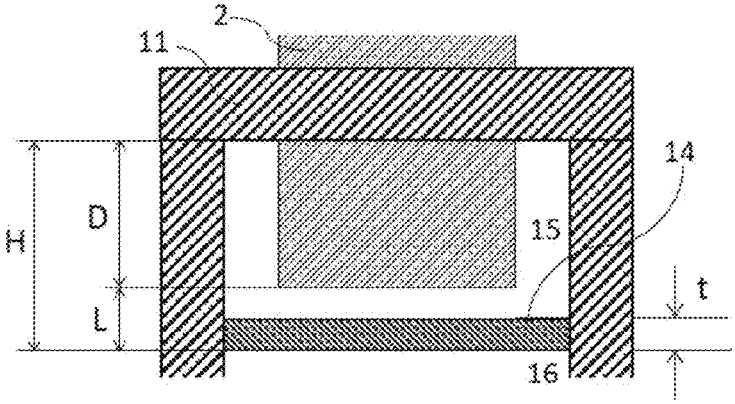
FIG. 7 is a partially-enlarged view of FIG. 6 of the heat exchanger according to Embodiment 1.
Figure 8:
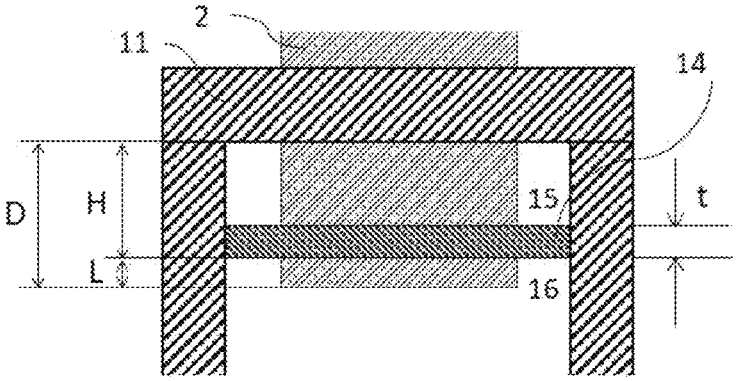
FIG. 8 is a partially-enlarged view of FIG. 6 of the heat exchanger according to Embodiment 1.
Figure 9:
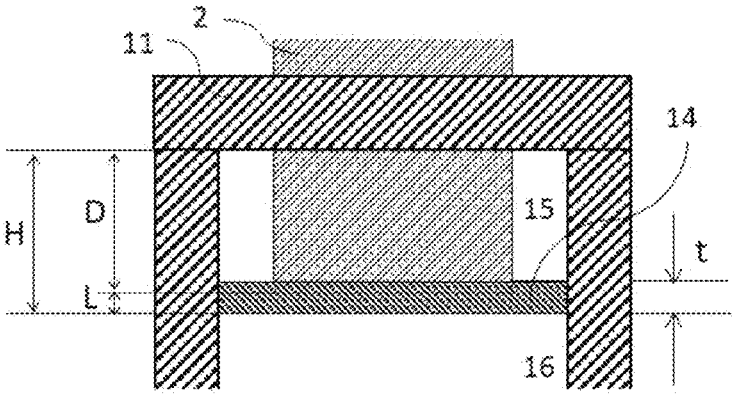
FIG. 9 is a partially-enlarged view of FIG. 6 of the heat exchanger according to Embodiment 1.

FIG. 6 is a cross-sectional view of the heat exchanger 100 according to Embodiment 1 as seen from cutting-plane line A-A of FIG. 1, FIGS. 7, 8, and 9 are each a partially-enlarged view of FIG. 6 of the heat exchanger 100 according to Embodiment 1. FIG. 7 is an enlarged view of a header in a case in which the front end of a heat transfer pipe 2 is in a first space 15. FIG. 8 is an enlarged view of the header in a case in which the front end of a heat transfer pipe 2 is in a second space 16. FIG. 9 is an enlarged view of the header in a case in which the front end of a heat transfer pipe 2 is on a level with the divider 14.

As shown in FIG. 6, the collecting header 1 b is divided by the divider 14 into a first space 15, situated beside the header top plate 11, in which an insertion hole 11*a* for a heat transfer pipe 2 is provided and a second space 16 to which the refrigerant outflow pipe 4*b* (not illustrated) is connected. The first space 15 and the second space 16 are different spaces, and the divider 14 is installed such that the first space 15 and the second space 16 are arranged one above the other. Further, it is preferable that, as shown in FIG. 6, the divider 14 be installed such that the second space 16 is larger than the first space 15. It should be noted that the first space 15 and the second space 16 are refrigerant flow passages communicating with each other in a direction from front to back of the sheet of FIG. 6, that is, in a direction parallel with the length of the collecting header 1*b*.

Since the divider 14 is provided with an opening 14*a* surrounding the outer periphery of the front end of the heat transfer pipe 2 as seen from the second direction (Y direction), the divider 14 is installed such that the front end of the heat transfer pipe 2 is located in the first space 15, at the same position as the divider 14, or in the second space 16, Assume here that in the second direction (Y direction) of FIGS. 6, 7, 8, and 9, the "insertion length D" is the distance between the insertion hole 11*a* and the front end of the heat transfer pipe 2, the "first space height H" is the distance between the insertion hole 11 a and the divider 14, the "gap distance L" is the distance between the divider 14 and the front end of the heat transfer pipe 2, and "t" is the thickness of the divider 14.

As shown in FIGS. 7, 8, and 9, the divider 14 according to Embodiment 1 of the present disclosure is provided such that the gap distance L is shorter than the insertion length D and smaller than the first space height H. That is, the divider 14 is installed such that the relationships L<D and L<H are satisfied. In this case, the front end of the heat transfer pipe 2 is in the first space 15 or the second space 16.

Further, in a case in which the divider 14 is installed such that the front end of the heat transfer pipe 2 is located in the first space 15 as shown in FIG. 7, it is more preferable that the divider 14 be installed such that the gap distance L is shorter than a distance half as long as the first space height H. That is, it is more preferable that the divider 14 be installed such that L<D/2 is satisfied.

Further, in a case in which the divider 14 is installed such that the front end of the heat transfer pipe 2 is located in the second space 16 as shown in FIG. 8, it is more preferable that the divider 14 be installed such that the gap distance L is shorter than a distance half as long as the second space height H. That is, it is more preferable that the divider 14 be installed such that L<H/2 is satisfied.

It should be noted that a comparison between the case in which the divider 14 is installed such that the front end of the heat transfer pipe 2 is located in the first space 15 (FIG. 7) and the case in which the divider 14 is installed such that the front end of the heat transfer pipe 2 is located in the second space 16 (FIG. 8) shows that it is more preferable that the divider 14 be installed such that the front end of the heat transfer pipe 2 is located in the second space 16 (FIG. 8). That is, it is more preferable that the divider 14 be installed such that the front end of the heat transfer pipe 2 is in the second space 16.

Furthermore, it is more preferable that the divider 14 be installed such that the gap distance L is less than or equal to the thickness t of the divider 14 as shown in FIG. 9. That is, it is most preferable that the divider 14 be installed such that L≤t is satisfied.

Next, the flow and pressure loss of refrigerant inside the collecting header are described.

Figure 10:
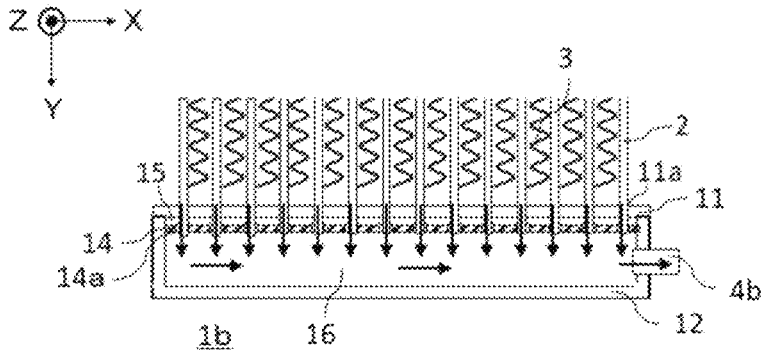
FIG. 10 is a cross-sectional view of the heat exchanger according to Embodiment 1 as taken along a plane parallel to a first direction.
Figure 11:
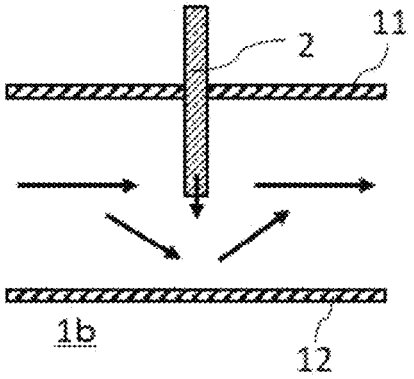
FIG. 11 is a schematic view showing a flow of refrigerant inside the collecting header according to Embodiment 1.
Figure 12:
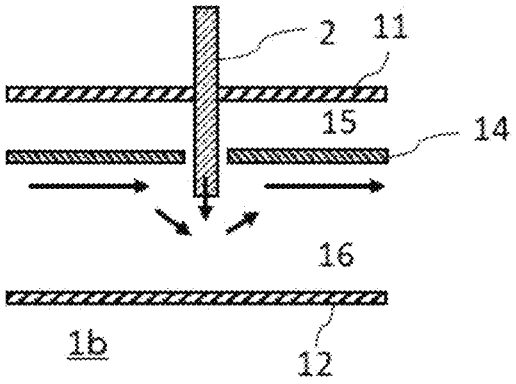
FIG. 12 is a schematic view showing a flow of refrigerant inside the collecting header according to Embodiment 1.

FIG. 10 is a cross-sectional view of the heat exchanger 100 according to Embodiment 1 as taken along a plane parallel to the first direction (X direction). FIGS. 11 and 12 are each a diagram showing a flow of refrigerant inside the collecting header according to Embodiment 1. FIG. 11 is a diagram showing a flow of refrigerant in a case in which no divider 14 is installed, and FIG. 12 is a diagram showing a flow of refrigerant in a case in which the divider 14 is installed, In FIGS. 10, 11, and 12, flows of refrigerant are schematically indicated by solid arrows.

As shown in FIG. 10, refrigerant flowing out of the heat transfer pipes 2 flows into the second space 16 through the openings 14*a* provided in the divider 14. At this point in time, since the opening areas of the openings 14*a* are larger than the cross-sectional areas of the front ends of the heat transfer pipes 2, refrigerant flowing out from the heat transfer pipes 2 flows into the second space 16 without colliding with the divider 14. The outflows of refrigerant from the heat transfer pipes 2 merge in the second space 16 and is discharged out of the heat exchanger 100 through the refrigerant outflow pipe 4*b* provided in a side of the second space 16.

As shown in FIG. 11, a heat transfer pipe 2 needs to be inserted into the collecting header 1*b* by a certain length so that the heat transfer pipe 2 is fixed to the header top plate 11. However, inserting the heat transfer pipe 2 by a length needed to fix the heat transfer pipe 2 causes ridges and grooves to be formed inside the collecting header 1*b* by the heat transfer pipe 2 thus inserted. Such ridges and grooves are hereinafter sometimes referred to as "raised and depressed portions" for descriptive purposes. The front end of the heat transfer pipe 2 forms a raised portion, and portions of the collecting header 1*b* in which no heat transfer pipes 2 are inserted form depressed portions. Since refrigerant inside the collecting header flows toward the refrigerant outflow pipe, the ridge and grooves formed by the heat transfer pipe 2 causes expansion and contraction of a refrigerant flow passage. The refrigerant is subjected to a pressure loss by expansion and contraction of a refrigerant flow passage. Further, in a case in which a plurality of the heat transfer pipes 2 are inserted, expansion and contraction of a refrigerant flow passage occur repetitively, so that there is a further increase in pressure loss of refrigerant flowing through the collecting header 1*b*.

Further, inside the header, there are a pressure loss caused by the friction between an inner wall surface of the inside of the header and refrigerant and a pressure loss caused by the inflow of refrigerant from the heat transfer pipe 2 and the confluence of refrigerant flowing through the collecting header 1*b* and refrigerant flowing in from the heat transfer pipe 2. In particular, a pressure loss caused by the raised and depressed portions formed by the heat transfer pipe 2 advantageous effects a great decrease in performance of the heat exchanger 100.

As shown in FIG. 12, in a case in which a divider 14 having an opening 14*a* surrounding the outer periphery of the front end of the heat transfer pipe 2 as seen from the second direction (Y direction) is provided inside the collecting header 1*b*, refrigerant flowing out through the front end of the heat transfer pipe 2 flows into the collecting header 1*b* through the opening 14*a* without colliding with the divider 14. The refrigerant flowing into the collecting header 1*b* flows through the second space 16 toward the refrigerant outflow pipe 4*b*. That is, the refrigerant flows mainly through the second space 16, which is a space between the divider 14 and the collecting header body. Further, since the opening 14*a* provided in the divider 14 is larger than the cross-sectional area of the front end of the heat transfer pipe 2, a portion of the refrigerant flowing through the collecting header 1*b* flows through the first space 15.

In a case in which the divider 14 is provided as shown in FIG. 12, the front end of the heat transfer pipe 2 form a raised portion and surfaces of the divider 14 that face the second space 16 serve as depressed portions. That is, the insertion of the heat transfer pipe 2 forms smaller raised and depressed portions than in a case in which no divider 14 is installed. The smaller raised and depressed portions result in a reduction in expansion and contraction of a refrigerant flow passage, making it possible to reduce a pressure loss of refrigerant flowing through the collecting header. Further, since the refrigerant flows mainly through the second space inside the collecting header, the effect exerted on a pressure loss of refrigerant by the raised and depressed portions formed by the insertion of the heat transfer pipe can be reduced even in a case in which the divider 14 is installed such that the front end of the heat transfer pipe is located in the first space 15.

Further, since refrigerant flowing out through the front end of the heat transfer pipe 2 flows into the second space 16 without colliding with the divider 14, a pressure loss caused by a collision of refrigerant with the divider 14 too can be reduced. This makes it possible to reduce a pressure loss of refrigerant flowing through the collecting header.

Next, advantageous effects of the heat exchanger 100 according to the present embodiment are described.

In a heat exchanger 100 according to Embodiment 1, a divider 14 including an opening 14*a* surrounding the outer periphery of the front end of a heat transfer pipe 2 as seen from a second direction (Y direction) is disposed to divide the inside of a header into a first space 15 in which an insertion hole 11*a* for the heat transfer pipe 2 is provided and a second space 16 to which a refrigerant outflow pipe 4 is connected. This causes only small raised and depressed portions to be formed by the insertion of the heat transfer pipe 2 into a collecting header 1*b*, thus making it possible to reduce expansion and contraction of a refrigerant flow passage inside the collecting header. Therefore, providing the divider 14 reduces expansion and contraction of a refrigerant flow passage and therefore reduces any changes in cross-sectional area of a refrigerant flow passage inside the collecting header, making it possible to reduce a pressure loss of refrigerant flowing inside.

Further, providing the divider 14 allows refrigerant flowing out through the front end of the heat transfer pipe 2 inserted in the header to flow into the second space 16, which is a main flow passage, without colliding with the divider 14. In the preceding example, which is configured to have a portion in which a heat transfer pipe 2 and a communicating hole do not overlap each other as the communicating hole is tilted, there is a risk that refrigerant flowing out through the front end of the heat transfer pipe 2 may suffer a pressure loss by colliding with the divider 14. On the other hand, as in the case of the heat exchanger 100 according to Embodiment 1, providing a divider 14 of the aforementioned configuration inside the collecting header 1*b* makes it possible to reduce a pressure loss caused by a collision with the divider 14 of refrigerant flowing out through the front end of the heat transfer pipe 2. This makes it possible to provide a heat exchanger 100 having superior heat exchange performance.

Further, the opening 14*a* is shaped to have a gap between the opening 14*a* and the outer periphery of the front end of the heat transfer pipe 2 when seen from the second direction. This makes it easier for the refrigerant flowing out through the front end of the heat transfer pipe 2 to avoid colliding with the divider 14, making it possible to reduce a pressure loss. It should be noted that in a case in which the divider 14 is installed such that the front end of the heat transfer pipe 2 is in the second space 16, it is possible for refrigerant to flow through the gap formed between the opening 14*a* and the outer periphery of the heat transfer pipe 2. This eliminates the need to provide a communicating hole separately and leads to a reduction in cost.

Further, the opening 14*a* is configured such that the width K of the opening 14*a* is smaller than the distance W between the adjacent heat transfer pipes 2. The opening area of the opening 14*a* is larger than the cross-sectional area of the front end of the heat transfer pipe 2, but when the opening area is too large, most of the refrigerant flowing through the second space 16 flows into the first space via the opening 14*a*. That is, when the opening area of the opening 14*a* is too large, ridges and grooves approximate to those which are formed in a case in which no divider 14 is provided.

This ray cause expansion and contraction of a refrigerant flow passage to increase a pressure loss. Accordingly, a pressure loss inside the collecting header 1*b* can be further reduced by configuring the opening 14*a* to satisfy the relationship $K<W$.

Further, installing the divider 14 such that the relationships $L<D$ and $L<H$ are satisfied causes even smaller ridges and grooves to be formed by the insertion of the heat transfer pipes 2 and brings about a further reduction in expansion and contraction of a refrigerant flow passage. That is, causing the distance L in the second direction (Y direction) between the front end of each of the plurality of heat transfer pipes 2 inserted in the header and the divider 14 to be shorter than the distance D in the second direction (Y direction) between the front end of each of the plurality of heat transfer pipes 2 and the insertion hole and shorter than the distance H in the second direction (Y direction) between the divider and the insertion hole reduces any changes in cross-sectional area of a refrigerant flow passage inside the collecting header 1*b*, making it possible to further reduce a pressure loss of refrigerant flowing through the collecting header.

Further, in a case in which the front end of the heat transfer pipe 2 is in the first space 15, installing the divider 14 such that the relationship $L<D/2$ is satisfied shortens the distance between the front end of the heat transfer pipe 2 and the second space 16.

This makes it easy for refrigerant to flow into the second space 16, thus making it possible to reduce a pressure loss. That is, causing the distance L in the second direction (Y direction) between the front end of each of the plurality of heat transfer pipes 2 inserted in the header and the divider 14 to be shorter than a distance half as long as the insertion length 0 shortens the distance between the front end of the heat transfer pipe 2 and the opening 14*a* of the divider 14. This makes it easy for refrigerant to flow from the heat transfer pipe 2 into the second space 16, making it possible to further suppress an increase in pressure loss. Meanwhile, in a case in which the front end of the heat transfer pipe 2 is in the second space 16, installing the divider 14 such that the relationship $L<H/2$ is satisfied shortens the distance between the front end of the heat transfer pipe 2 and the divider 14. This can cause even smaller ridges and grooves to be formed by the insertion of the heat transfer pipes 2, thus making it possible to further reduce a pressure loss.

Further, installing the divider 14 such that the relationship $L \leq t$ is satisfied almost completely eliminates expansion and contraction of a refrigerant flow passage by the insertion of the heat transfer pipe 2. That is, causing the distance L in the second direction (Y direction) between the front end of the heat transfer pipe 2 inserted in the header and the opening 14*a* to be less than or equal to the thickness t of the divider 14 causes the front end of the heat transfer pipe 2 to be substantially on a level with the divider 14, almost completely eliminating ridges and grooves. That is, the cross-sectional area of a refrigerant flow passage inside the collecting header 1*b* is held almost constant. This makes it possible to prevent refrigerant flowing in the first direction (X direction) through the second space 16 from being affected by expansion and contraction of a flow passage and makes it possible to further reduce a pressure loss of refrigerant flowing through the collecting header.

Further, installing the divider 14 such that the second space 16 is larger than the first space makes it easy for refrigerant to flow through the second space 16, which is a main flow passage, leading to improvement in heat exchange performance.

Further, installing the divider 14 such that the front end of the heat transfer pipe 2 is in the second space 16 allows the refrigerant flowing out through the front end of the heat transfer pipe 2 to flow into the second space 16, thus making it possible to reduce a pressure loss caused by a collision with the divider 14.

Figure 13:
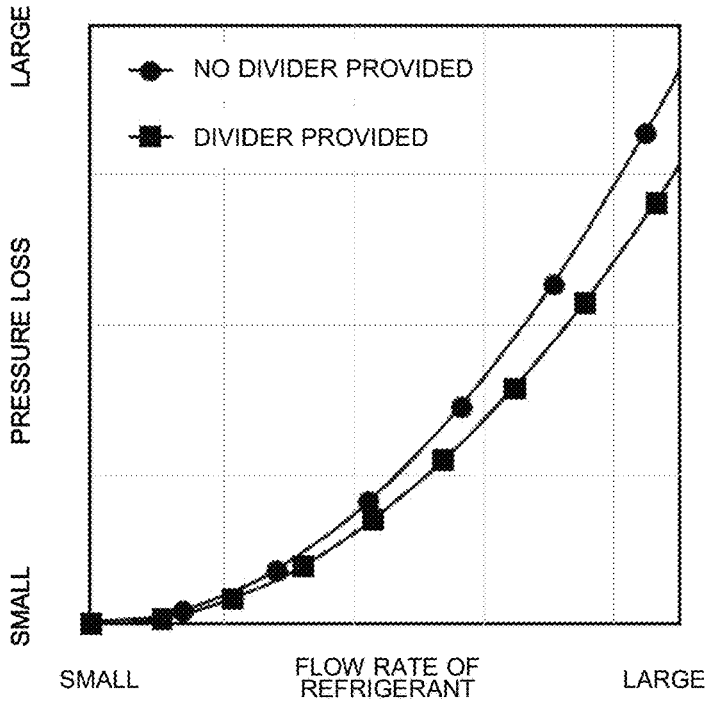
FIG. 13 is a diagram showing changes in flow rate and pressure loss of refrigerant inside the collecting header according to Embodiment 1.

FIG. 13 is a diagram showing changes in flow rate and pressure loss of refrigerant inside the collecting header according to Embodiment 1 in a case in which the divider 14 is installed and a case in which no divider 14 is provided. The vertical axis represents a pressure loss inside the collecting header, and the horizontal axis represents the amount of refrigerant that flows into the collecting header 1*b*. A pressure loss caused in a case in which the divider 14 is installed inside the collecting header is indicated by quadrangular plots, and a pressure loss caused in a case in which no divider 14 is installed inside the collecting header is indicated by circular plots. It should be noted that the installation position of the divider 14 is such a position that the relationships L<D and L<H are satisfied and the front end of the heat transfer pipe 2 is in the second space 16.

As can be seen from FIG. 13, the pressure loss is smaller at each flow rate of refrigerant in a case in which the divider 14 is installed (quadrangular plots) than in a case in which no divider 14 is installed (circular plots). That is, installing the divider 14 according to Embodiment 1 in the collecting header 1*b* makes it possible to reduce the pressure loss. In particular, the pressure loss is smaller at a higher flow rate of refrigerant in a case in which the divider 14 is installed (quadrangular plots) than in a case in which no divider 14 is installed (circular plots). This shows that the installation of the divider 14 is more effective in reducing the pressure loss at a higher flow rate of refrigerant.

As noted above, a heat exchanger 100 according to Embodiment 1 includes a plurality of heat transfer pipes 2 provided at spacings from each other in a first direction (X direction), a header 1 having an insertion hole 11*a* in which a front end of each of the plurality of heat transfer pipes 2 is inserted from a second direction (Y direction) orthogonal to the first direction, and a fin 3 attached between heat transfer pipes 2. Furthermore, the header 1 includes a divider 14 configured to divide an inside of the header into a first space 15 in which the insertion hole 11*a* is provided and a second space 16 to which a refrigerant pipe 4 is connected. The divider 14 is provided with an opening 14*a* surrounding an outer periphery of the front end of the heat transfer pipe as seen from the second direction (Y direction). This configuration makes it possible to provide a heat exchanger 100 configured to reduce a pressure loss of refrigerant and be superior in heat exchange performance even with heat transfer pipes 2 inserted in the heat exchanger 100.

Figure 14:
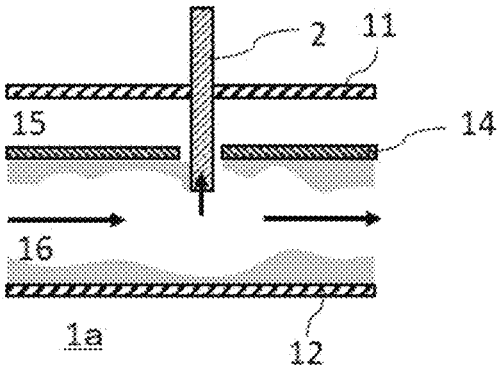
FIG. 14 is a schematic view showing a flow of refrigerant through a distributing header according to Embodiment 1.

Note here that although the heat exchanger 100 according to Embodiment 1 has been described by taking the collecting header 1*b*, in which gas refrigerant is collected, as an example, the distributing header 1*a*, through which two-phase gas-liquid refrigerant flows as shown in FIG. 14, may be taken as an example. FIG. 14 is a diagram showing a flow of refrigerant through the distributing header of the heat exchanger 100 according to Embodiment 1.

Further, examples of refrigerant flowing through the heat exchanger 100 according to Embodiment 1 include a propane refrigerant, an HFO refrigerant, an ammonium refrigerant, and a dimethyl ether refrigerant. In a case in which a refrigerant, such as these refrigerant, that is lower in density than commonly-used R32 under conditions where the heat exchanger 100 acts as an evaporator in an air-conditioning apparatus 200 or a refrigerant mixture having any of these refrigerants added thereto as an ingredient is used, an effect of reducing a pressure loss can be especially enhanced.

Further, although Embodiment 1 has illustrated an example in which the heat transfer pipes are aligned in one row, the heat transfer pipes may be aligned in two or more rows without being limited to being aligned in one row.

Embodiment 2

A heat exchanger 100 according to Embodiment 2 of the present disclosure is described with reference to FIGS. 15 and 16. The heat exchanger 100 according to Embodiment 2 differs in the number of openings 14*a* of the divider 14 from the heat exchanger 100 according to Embodiment 1. It should be noted that a description of features that overlap those of Embodiment 1 is omitted, and components that are identical or equivalent to those of Embodiment 1 are assigned identical reference signs.

Figure 15:
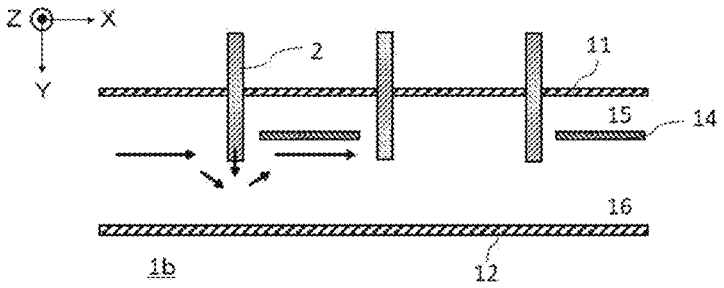
FIG. 15 is a cross-sectional view of a heat exchanger according to Embodiment 2 as taken along a plane parallel to the first direction.
Figure 16:
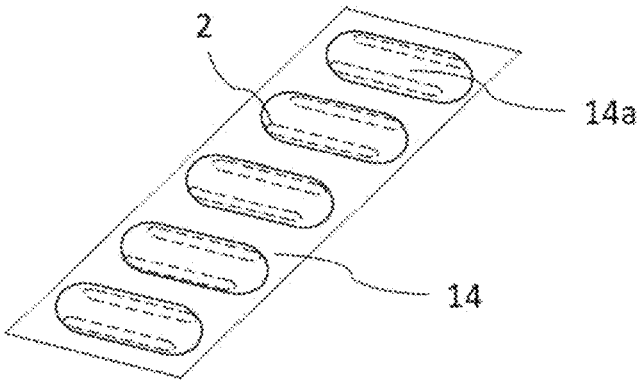
FIG. 16 is a perspective view of a divider according to Embodiment 2.

FIG. 15 is a cross-sectional view of a collecting header 1*b* according to Embodiment 2 as taken along a plane parallel to the first direction (X direction). FIG. 16 is a perspective view of a divider 14 according to Embodiment 2, using dashed lines to indicate the positions of heat transfer pipes 2.

On one hand, Embodiment 1 has been described by taking as an example a case in which the number of heat transfer pipes 2 inserted in the collecting header 1*b* and the number of openings 14*a* of the divider 14 are equal. In Embodiment 2, on the other hand, the number of openings 14*a* is smaller than the number of heat transfer pipes 2 as shown in FIG. 16. As shown in FIG. 16, the openings 14*a* according to Embodiment 2 are provided in such positions that two adjacent heat transfer pipes 2 can be inserted into one opening 14*a* when seen from the second direction.

Such a configuration allows refrigerant flowing out through the front end of a heat transfer pipe 2 to flow into the second space 16 without colliding with the divider 14, making it possible to reduce a pressure loss. This makes it possible to provide a heat exchanger 100 having superior heat exchange performance.

Embodiment 3

A heat exchanger 100 according to Embodiment 3 of the present disclosure is described with reference to FIGS. 17 and 18. Embodiment 3 differs in the shape of an opening 14*a* of the divider 14 according to Embodiment 1. It should be noted that a description of features that overlap those of Embodiment 1 is omitted, and components that are identical or equivalent to those of Embodiment 1 are assigned identical reference signs.

Figure 17:
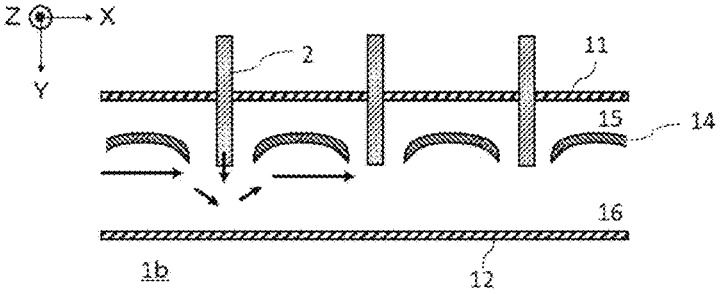
FIG. 17 is a cross-sectional view of a heat exchanger according to Embodiment 3 as taken along a plane parallel to the first direction.
Figure 18:
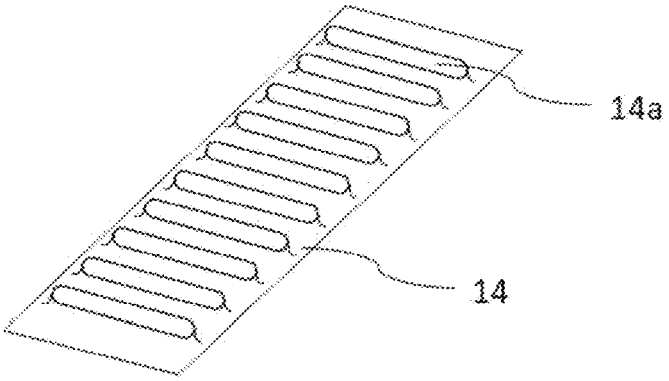
FIG. 18 is a perspective view of a divider according to Embodiment 3.

FIG. 17 is a cross-sectional view of a collecting header 1*b* according to Embodiment 3 as taken along a plane parallel to the first direction (X direction). FIG. 18 is a perspective view of a divider 14 according to Embodiment 3.

As shown in FIG. 17, the opening 14*a* of the divider of Embodiment 3 is shaped to include a tapered portion configured to incrementally enlarge an opening area of the opening 14*a* from the first space toward the second space 16. That is, the opening 14*a* gradually enlarges from the first space toward the second space 16. For example, as shown in FIG. 17, the shape may be inclined to extend toward the end of a heat transfer pipe 2.

Such a configuration brings about advantageous effects that are similar to those of Embodiment 1. In addition, the tapered portion makes it possible to cause even smaller ridges and grooves to be formed by the insertion of the heat transfer pipes 2, further lessening expansion and contraction of a refrigerant flow passage inside the collecting header 1*b*. This makes it possible to further reduce a pressure loss of refrigerant flowing through the second space 16 of the header, making it possible to provide a heat exchanger 100 having superior heat exchange performance. Further, providing the tapered portion also makes it possible to prevent the front end of the heat transfer pipe 2 from being damaged by colliding with the edge of the opening 14*a* of the divider 14 in a case in which the front end of the heat transfer pipe 2 is inserted into the opening 14*a*.

Embodiment 4

A heat exchanger 100 according to Embodiment 4 of the present disclosure is described with reference to FIGS. 19 and 20. Embodiment 4 differs in the shape of the divider 14 according to Embodiment 1. It should be noted that a description of features that overlap those of Embodiment 1 is omitted, and components that are identical or equivalent to those of Embodiment 1 are assigned identical reference signs.

Figure 19:
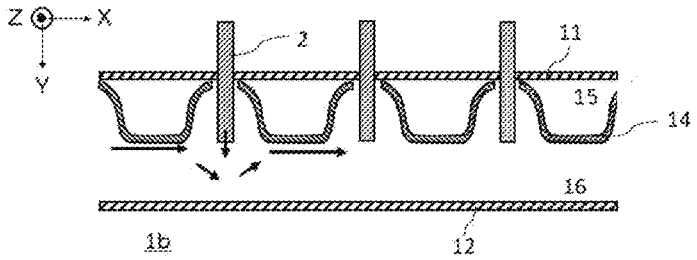
FIG. 19 is a cross-sectional view of a heat exchanger according to Embodiment 4 as taken along a plane parallel to the first direction.
Figure 20:
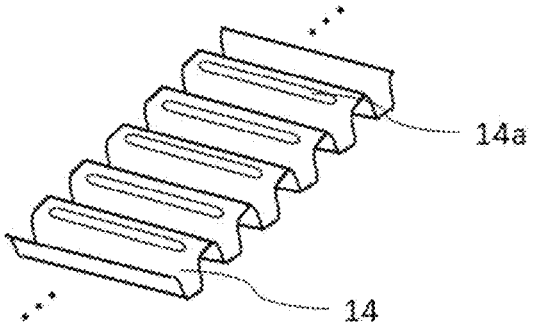
FIG. 20 is a perspective view of a divider according to Embodiment 4.

FIG. 19 is a cross-sectional view of a collecting header 1*b* according to Embodiment 4 as taken along a plane parallel to the first direction (X direction). FIG. 20 is a perspective view of a divider 14 according to Embodiment 4.

As shown in FIG. 19, the divider 14 according to Embodiment 4 is in a corrugated shape having raised and depressed portions at spacings smaller than a width of each of the adjacent heat transfer pipes 2. That is, the ridges and grooves of the corrugated shape are smaller than the pitch between the heat transfer pipes 2. It is preferable that, as shown in FIG. 20, the opening 14*a* be provided at the top of a raised portion of the corrugated shape and each of the depressed portions have a flat bottom. The divider 14 is fixed with the raised portions of the corrugated shape in contact with the header top plate 11.

In Embodiment 4, the first space 15 is divided in the first direction every heat transfer pipe 2. Further, the gap between the heat transfer pipe 2 and the opening 14*a* is closed by the header top plate 11. For this reason, it is desirable to allow communication between the first space 15 and the second space 16, for example, by making the width of the divider 14 in the third direction (Z direction) smaller than the width of the inside of the header or partially forming a notch at an edge of the divider 14 in the third direction (Z direction). Such a configuration not only brings about advantageous effects that are similar to those of Embodiment 1 but also makes it possible to reduce the fixed cost of the divider 14.

Embodiment 5

An air-conditioning apparatus 200 according to Embodiment 5 of the present disclosure is described with reference to FIG. 21. Embodiment 5 is directed to an air-conditioning apparatus 200 including a heat exchanger 100 according to any one of Embodiments 1 to 4 as a condenser or an evaporator. It should be noted that a description of features that overlap those of Embodiment 1 is omitted, and components that are identical or equivalent to those of Embodiment 1 are assigned identical reference signs.

Figure 21:
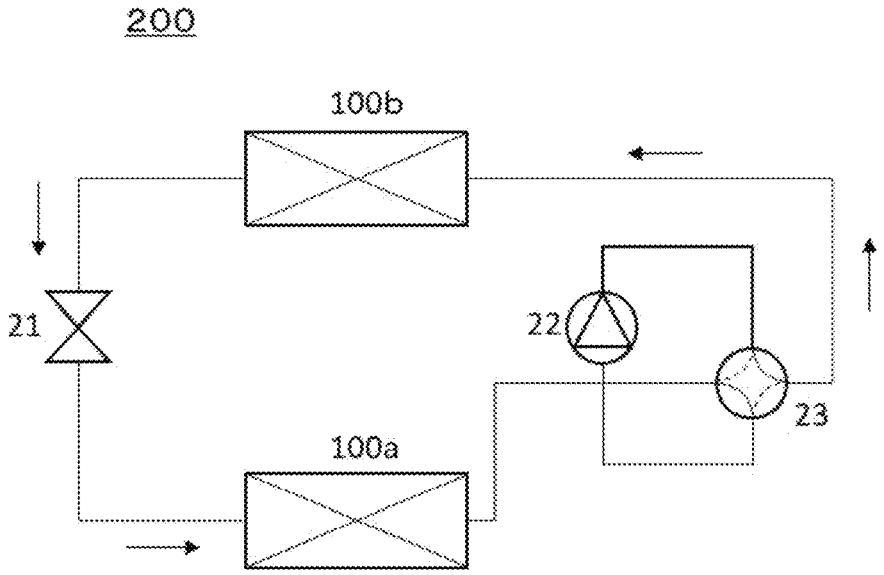
FIG. 21 is a refrigerant circuit diagram showing an air-conditioning apparatus according to Embodiment 5.

FIG. 21 is a refrigerant circuit diagram showing an air-conditioning apparatus 200 mounted with heat exchangers 100 (100*a*, 100*b*) according to any one of Embodiments 1 to 4. It should be noted that the solid arrows of FIG. 21 indicate the flow of refrigerant during heating operation, and a description is given here by taking heating operation as an example.

In the air-conditioning apparatus 200 according to Embodiment 5, as shown in FIG. 21, the heat exchangers 100 (100*a*, 100*b*) described in Embodiment 1 to 4 are mounted as a condenser or an evaporator in an indoor unit or an outdoor unit. During heating operation, the heat exchanger 100*a* serves as an evaporator, and the heat exchanger 100*b* serves as a condenser. The air-conditioning apparatus 200 includes a refrigerant circuit configured such that a compressor 22, a condenser; an expansion valve 21, an evaporator, and a four-way valve 23 are connected by pipes as shown in FIG. 21.

The refrigerant is compressed by the compressor 22 into high-temperature and high-pressure gas refrigerant. After that, the gas refrigerant flows into the condenser. In the heat exchanger 100*b*, which functions as the condenser, the gas refrigerant condenses into high-pressure liquid refrigerant by exchanging heat with a fluid such as air. The liquid refrigerant is then decompressed by the expansion valve 21 into low-temperature and low-pressure two-phase gas-liquid refrigerant that then flows into the evaporator. In the heat exchanger 100*a*, which functions as the evaporator, the two-phase gas-liquid refrigerant evaporates into gas refrigerant by exchanging heat with a fluid such as air. The refrigerant, which is now gas refrigerant, returns to the compressor 22.

Further, switching to another circuit with the four-way valve 23 inverts the flow of refrigerant and enables cooling operation. During cooling operation, the heat exchanger 100*a* serves as a condenser, and the heat exchanger 100*b* serves as an evaporator.

Mounting the heat exchanger 100 according to any one of Embodiments 1 to 4 as an evaporator or a condenser in the air-conditioning apparatus 200 not only brings about advantageous effects that are similar to those of Embodiments 1 to 4 but also makes it possible to provide an air-conditioning apparatus 200 including a heat exchanger 100 (100*a*, 100*b*) having superior heat exchange performance.

As noted above, an air-conditioning apparatus 200 according to Embodiment 5 includes a refrigerant circuit in which a compressor 22, a condenser, an expansion valve 21, an evaporator, and a four-way valve 23 are connected by pipes and through which the refrigerant flows, and includes the heat exchanger 100 according to any one of Embodiments 1 to 4 as the condenser or the evaporator. This makes it possible to provide an air-conditioning apparatus 200 including a heat exchanger 100 having superior heat exchange performance.

Note here that although Embodiment 5 has illustrated an example in which the heat exchangers 100 described in Embodiments 1 to 4 are applied to a condenser or an evaporator, it is most preferable, in particular, that the configuration of the heat exchangers 100 described in Embodiments 1 to 4 be applied to an evaporator including a collecting header 1*b* configured to collect gas refrigerant from a plurality of heat transfer pipes 2 or a condenser including a distributing header configured to distribute gas refrigerant to a plurality of heat transfer pipes 2. A reason for this is that in a header 1 through which gas refrigerant flows, the velocity of refrigerant flowing out or flowing in through the front ends of the heat transfer pipes 2 is higher than in a header 1 through which two-phase gas-liquid refrigerant flows, so that a pressure loss caused by a collision with the divider 14 of the refrigerant flowing out through the front ends of the heat transfer pipes 2 tends to have a profound effect: however, the aforementioned heat exchangers 100 make it possible to reduce the pressure loss caused by the collision with the divider 14 and, furthermore, reduce a pressure loss of expansion and contraction caused by ridges and grooves formed by the insertion of the heat transfer pipes 2, so that a heat exchanger 100 having superior heat exchange performance can be provided.

It should be noted that the configuration of the heat exchanger 100 according to Embodiment 1 may be applied to an evaporator including a distributing header 1*a* configured to distribute refrigerant to a plurality of heat transfer pipes 2 or a condenser including a collecting header 1*b* configured to collect refrigerant from a plurality of heat transfer pipes 2. In this case too, a pressure loss caused by a collision with the divider 14 is reduced and a pressure loss of expansion and contraction caused by ridges and grooves formed by the insertion of the heat transfer pipes 2 is reduced, so that a heat exchanger 100 having superior heat exchange performance can be provided. Further, since a pressure loss can be reduced, an effect is also brought about in a case in which the size of the header 1 is small.

It should be noted that proper combinations, modifications, and omissions of the embodiments are also encompassed in the scope of technical ideas disclosed in the embodiments.

Reference Signs List

1: header, 1*a:* distributing header, 1*b:* collecting header, 2: heat transfer pipe, 3: fin, 4: refrigerant pipe, 4*a:* refrigerant inflow pipe, 4*b:* refrigerant outflow pipe, 11: header top plate, 11*a:* insertion hole, 12: header body, 13: side lid, 14: divider, 14*a:* opening, 15: first space, 16: second space, 21: expansion valve, 22: compressor, 23: four-way valve, 100, 100*a,* 100*b:* heat exchanger, 200: air-conditioning apparatus

The invention claimed is:

1. A heat exchanger comprising:

a plurality of heat transfer pipes provided at spacings from each other in a first direction;

a header having an insertion hole in which a front end of each of the plurality of heat transfer pipes is inserted from a second direction orthogonal to the first direction; and a fin attached between adjacent ones of the plurality of heat transfer pipes, wherein the header includes a divider configured to divide an inside of the header into a first space in which the insertion hole is provided and a second space to which a refrigerant pipe is connected, the divider is provided with an opening surrounding an outer periphery of the front end of the heat transfer pipe as seen from the second direction, and the front end of the heat transfer pipe is in the second space.

2. The heat exchanger of claim 1, wherein the opening is shaped to have a gap between the opening and the outer periphery of the front end of the heat transfer pipe as seen from the second direction.

3. The heat exchanger of claim 2, wherein a width of the opening in the first direction is smaller than a distance between the adjacent heat transfer pipes.

4. The heat exchanger of claim 3, wherein a distance in the second direction between the front end of the heat transfer pipe inserted in the header and the opening is shorter than a distance in the second direction between the front end of the heat transfer pipe and the insertion hole and shorter than a distance in the second direction between the opening and the insertion hole.

5. The heat exchanger of claim 4, wherein the distance in the second direction between the front end of the heat transfer pipe inserted in the header and the opening is shorter than a distance half as long as the distance in the second direction between the front end of the heat transfer pipe and the insertion hole in a case in which the front end of the heat transfer pipe is in the first space and shorter than a distance half as long as the distance in the second direction between the opening and the insertion hole in a case in which the front end of the heat transfer pipe is in the second space.

6. The heat exchanger of claim 4, wherein the distance in the second direction between the front end of the heat transfer pipe and the opening is less than or equal to a thickness of the divider in the second direction.

7. The heat exchanger of claim 1, wherein a number of a plurality of the openings is smaller than a number of the plurality of heat transfer pipes.

8. The heat exchanger of claim 1, wherein the opening includes a tapered portion configured to incrementally enlarge an opening area of the opening from the first space toward the second space.

9. The heat exchanger of claim 1, wherein the divider is in a corrugated shape having raised and depressed portions at spacings smaller than a width of each of the adjacent heat transfer pipes.

10. The heat exchanger of claim 1, wherein refrigerant flowing through the heat exchanger is a propane refrigerant, an HFO refrigerant, an ammonium refrigerant, a dimethyl ether refrigerant, or a refrigerant mixture having any of these refrigerants added thereto as an ingredient.

11. An air-conditioning apparatus comprising a refrigerant circuit in which a compressor, a condenser, an expansion valve, an evaporator, and a four-way valve are connected by pipes and through which the refrigerant flows, wherein the air-conditioning apparatus includes the heat exchanger of claim 1 as the condenser or the evaporator.

12. A heat exchanger comprising:

a plurality of heat transfer pipes provided at spacings from each other in a first direction;

a header having an insertion hole in which a front end of each of the plurality of heat transfer pipes is inserted from a second direction orthogonal to the first direction; and a fin attached between adjacent ones of the plurality of heat transfer pipes, wherein the header includes a divider configured to divide an inside of the header in the second direction, into a first space in which the insertion hole is provided and a second space to which a refrigerant pipe is connected, the refrigerant pipe is connected to a side surface, which is an end face of the header in the first direction, the divider is provided with an opening surrounding an outer periphery of the front end of the heat transfer pipe as seen from the second direction, and the opening is shaped to have a gap between the opening and the outer periphery of the front end of the heat transfer pipe as seen from the second direction, wherein a number of a plurality of the openings is smaller than a number of the plurality of heat transfer pipes.

13. A heat exchanger comprising:

a plurality of heat transfer pipes provided at spacings from each other in a first direction;

a header having an insertion hole in which a front end of each of the plurality of heat transfer pipes is inserted from a second direction orthogonal to the first direction; and a fin attached between adjacent ones of the plurality of heat transfer pipes, wherein the header includes a divider configured to divide an inside of the header, in the second direction, into a first space in which the insertion hole is provided and a second space to which a refrigerant pipe is connected, the refrigerant pipe is connected to a side surface, which is an end face of the header in the first direction, the divider is provided with an opening surrounding an outer periphery of the front end of the heat transfer pipe as seen from the second direction, and the opening is shaped to have a gap between the opening and the outer periphery of the front end of the heat transfer pipe as seen from the second direction, wherein the divider is in a corrugated shape having raised and depressed portions at spacings smaller than a width of each of the adjacent heat transfer pipes.

* * * * *